US009002233B2

(12) United States Patent
Yamasaki et al.

(10) Patent No.: US 9,002,233 B2
(45) Date of Patent: Apr. 7, 2015

(54) PROCESS CARTRIDGE UNIT

(71) Applicant: Canon Kabushiki Kaisha, Tokyo (JP)

(72) Inventors: Toshiteru Yamasaki, Yokohama (JP); Fumito Nonaka, Mishima (JP); Akira Suzuki, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/056,824

(22) Filed: Oct. 17, 2013

(65) Prior Publication Data

US 2014/0119770 A1 May 1, 2014

(30) Foreign Application Priority Data

Oct. 29, 2012 (JP) ..... 2012-237794

(51) Int. Cl.
*G03G 15/08* (2006.01)
*G03G 21/18* (2006.01)

(52) U.S. Cl.
CPC ..... *G03G 21/181* (2013.01)

(58) Field of Classification Search
CPC ..... G03G 15/0898; G03G 15/0817; G03G 15/0881; G03G 15/0894
USPC ..... 399/103
See application file for complete search history.

(56) References Cited

U.S. PATENT DOCUMENTS

| | | | | |
|---|---|---|---|---|
| 5,485,249 | A | 1/1996 | Higeta | |
| 7,933,534 | B2 | 4/2011 | Hoshi | |
| 8,682,211 | B2 * | 3/2014 | Hoshi et al. | 399/103 |
| 2002/0064392 | A1 * | 5/2002 | Miura et al. | 399/103 |
| 2011/0286762 | A1 | 11/2011 | Hoshi | |
| 2013/0121720 | A1 * | 5/2013 | Hoshi et al. | 399/106 |
| 2014/0119770 | A1 * | 5/2014 | Yamasaki et al. | 399/103 |

FOREIGN PATENT DOCUMENTS

JP 2009265612 A 11/2009

* cited by examiner

*Primary Examiner* — WB Perkey
(74) *Attorney, Agent, or Firm* — Canon U.S.A., Inc. IP Division

(57) ABSTRACT

A unit includes an injection path provided on a frame member and through which a molten resin flows when a seal portion is formed through injection molding, an injection port provided at one end side of the injection path in an injection direction in which the molten resin flows through the injection path and through which the molten resin is injected into the frame member, and a discharge port which is provided at another end side of the injection path in the injection direction and through which the molten resin having passed through the injection path is discharged to a seal forming portion.

13 Claims, 28 Drawing Sheets

SECTION TAKEN ALONG LINE A'-A'

SECTION TAKEN ALONG LINE A-A

SECTION TAKEN ALONG LINE B-B

SECTION TAKEN ALONG LINE A-A

SECTION TAKEN ALONG LINE A-A

SECTION TAKEN ALONG LINE B-B

SECTION TAKEN ALONG LINE B-B

SECTION TAKEN ALONG LINE A'-A'

SECTION TAKEN ALONG LINE A'-A'

SECTION TAKEN ALONG LINE B'-B'

SECTION TAKEN ALONG LINE B'-B'

SECTION TAKEN ALONG LINE A'-A'

SECTION TAKEN ALONG LINE A'-A'

SECTION TAKEN ALONG LINE A'-A'

PROCESS CARTRIDGE UNIT

BACKGROUND OF THE INVENTION

1. Field of the Invention

The present invention relates to a unit to be used in an image forming apparatus.

2. Description of the Related Art

In an image forming apparatus for forming an image on a recording medium by employing the electrophotographic image forming process, there is known a configuration equipped with a process cartridge detachably attachable to an apparatus main body. The process cartridge is obtained by integrating into a unit an electrophotographic photosensitive member and process units configured to act on the electrophotographic photosensitive member, and includes at least one of a charging unit, a developing unit, and a cleaning unit. In a process cartridge system of this type, it is possible for a user to perform maintenance on the apparatus for himself of herself without relying on a service person, thus, the operability of the system can be substantial improved. Therefor, this process cartridge system is widely employed in electrophotographic image forming apparatuses. Examples of the electrophotographic image forming apparatus include an electrophotographic copying machine, an electrophotographic printer (e.g., a laser beam printer or a light-emitting diode (LED) printer), and a facsimile apparatus.

The conventional process cartridge is equipped with a toner container storing a new developer (toner) to be used to develop electrostatic latent images, and a waste toner chamber for storing a collected waste toner. In addition, in order to prevent the toner from leaking to the exterior, the process cartridge includes a configuration in which a seal member is mounted between a frame member of a cleaning container or a developing container and components such as a cleaning blade and a developing blade to thereby seal in the toner. As the seal member, there is employed an elastic member formed of a material such as urethane foam, soft rubber, an elastomer portion, or the like. When the seal member is provided on the frame member and the component, there is generally adopted a method in which the seal member is caused to undergo compressive deformation by a predetermined amount, and seals in the toner by utilizing the resultant repulsive force.

Japanese Patent Application Laid-Open No. 2009-265612 discusses a configuration in which, in order to improve operability in mounting a seal member to a frame member, injection molding is performed with elastomer, which is a molten resin, on the frame member, thereby forming the seal member.

In the configuration in which the seal member is formed on the frame member through injection molding, depending upon a position of an injection port through which the molten resin is injected into the frame member, there is the possibility of a surface configuration of the seal member being affected by a sink mark or the like at the time of cooling of the molten resin.

SUMMARY OF THE INVENTION

The present invention is directed to reliably securing a sealing performance of a seal member in a configuration in which a seal member is formed on a frame member through injection molding. More specifically, the present invention relates to a unit in which a sink mark is not easily generated on a surface of the seal member near an injection port for a molten resin in the configuration in which the seal member is formed on the frame member through the injection molding.

According to an aspect of the present invention, a unit to be used in an image forming apparatus includes a developer storage portion configured to store a developer, a frame member, a seal forming portion provided on the frame member, a seal member configured to prevent leakage of the developer to an exterior of the unit and to be formed on the seal forming portion through injection molding with a molten resin, an injection path provided in the frame member and through which the molten resin flows when the seal member is formed through injection molding, an injection port provided at one end side of the injection path in an injection direction in which the molten resin flows through the injection path, and through which the molten resin is injected into the frame member, and a discharge port which is provided at another end side of the injection path in the injection direction and is configured to discharge the molten resin having passed through the injection path to the seal forming portion. The injection path includes a region penetrating linearly through a portion of the injection port and a portion of the discharge port in the injection direction and connecting them to each other.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. The dimensions, materials, configurations, and the relative arrangements of the components as described in connection with the exemplary embodiments are to be changed as appropriate according to the configuration of the apparatus and on various conditions to which the present invention is applied. In other words, the scope of the present invention is not to be restricted to the exemplary embodiments described below.

In the following description, a longitudinal direction of a process cartridge refers to a direction intersecting a direction in which the process cartridge is attached to the electrophotographic image forming apparatus main body (i.e., a direction substantially orthogonal thereto, or a rotation axis direction of an image bearing member). A right-hand side and a left-hand side of the process cartridge refer to the right-hand side and the left-hand side when the process cartridge is seen from a direction in which the process cartridge is attached to the electrophotographic image forming apparatus. An upper surface of the process cartridge is a surface situated on an upper side in the state in which the process cartridge has been attached to the electrophotographic image forming apparatus main body, and a lower surface is a surface situate on a lower side in this state.

(Configuration of Image Forming Apparatus Main Body)

Figure 1:
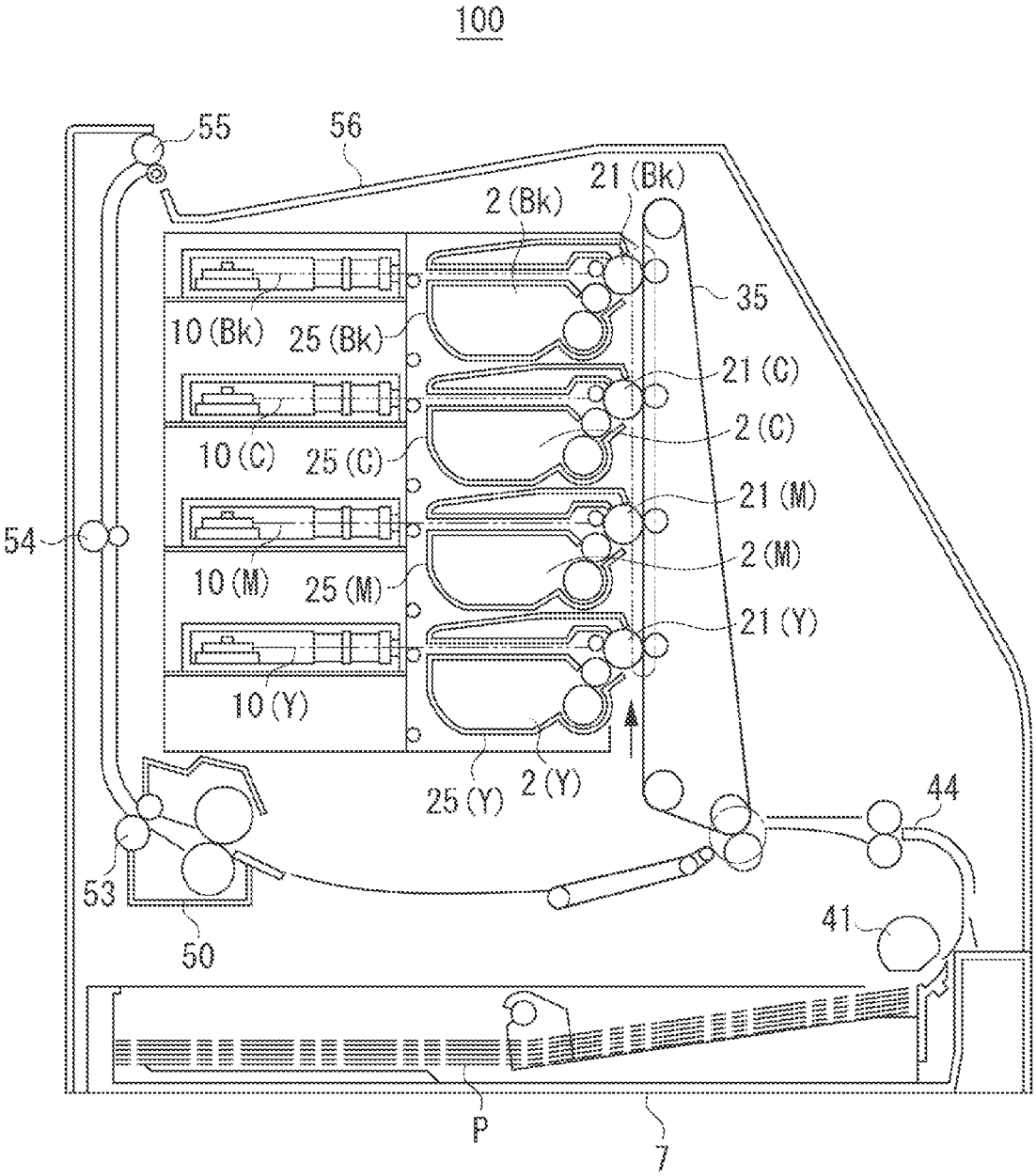
FIG. 1 is a schematic sectional view illustrating an overall configuration of an image forming apparatus.

Referring to FIG. 1, a configuration of an electrophotographic image forming apparatus main body according to an exemplary embodiment of the present invention will be described. FIG. 1 is a schematic sectional view of a color laser beam printer (hereinbelow referred to as "the image forming apparatus main body") which is a form of the image forming apparatus. An image forming apparatus main body 100 is equipped with process cartridges 2 of yellow (Y), magenta (M), cyan (C), and black (Bk) colors, an intermediate transfer belt (intermediate transfer member) 35, a fixing unit 50, discharge roller pairs 53, 54, and 55, and a discharge tray 56. The process cartridges 2 for the four colors are individually detachably attachable with respect to the image forming apparatus main body 100.

Next, operations of the image forming apparatus main body 100 will be described. First, a sheet feeding roller 41 rotates to separate one of transfer materials P in a sheet feeding cassette 7, and then conveys the transfer material P to a registration roller 44. On the other hand, an image bearing member 21 and the intermediate transfer member 35 rotate in a direction of an arrow in FIG. 1 at a predetermined outer peripheral velocity V (hereinbelow referred to as the process speed). A surface of the image bearing member 21 is uniformly charged by a charging unit, and is then subjected to exposure by a laser 10, thus an electrostatic latent image is formed thereon. Simultaneously with this latent image formation, a developing unit 2*b* performs development on the latent image on the image bearing member 21 with a developer (hereinbelow referred to as the "toner"). The respective color images in the colors of Y, M, C, and Bk developed on the image bearing member 21 are primarily transferred to an outer periphery of the intermediate transfer member 35. The images of the respective colors transferred onto the intermediate transfer member 35 are secondarily transferred to the transfer material P, and are then fixed to the transfer material P by the fixing unit 50. The transfer material P to which the images have been fixed is discharged onto the discharge tray 56 via discharge roller pairs 53, 54, and 55, with which the image forming operation is completed.

(Configuration of Process Cartridge)

Figure 2:
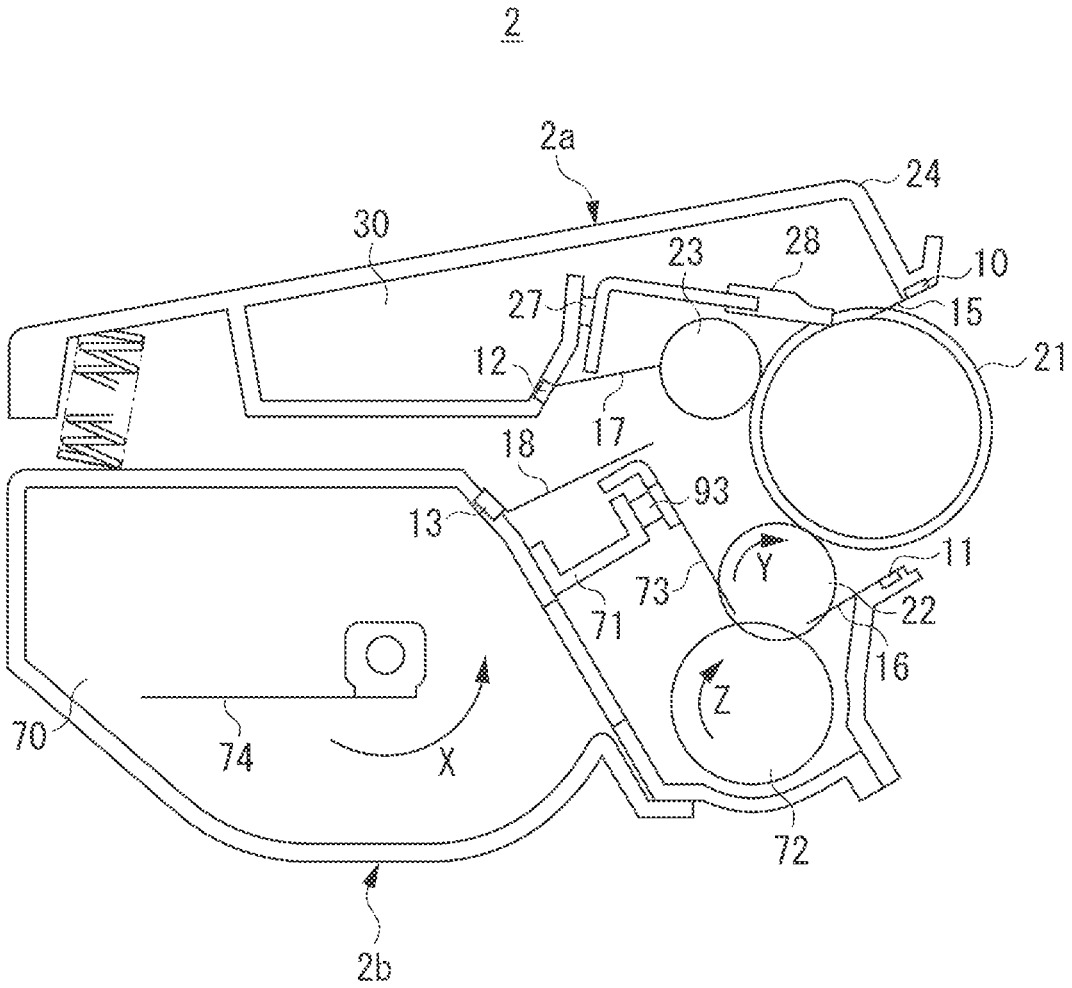
FIG. 2 is a schematic sectional view of a process cartridge.

Referring to FIG. 2, the configuration of the process cartridge 2 according to the present exemplary embodiment of the present invention will be described. FIG. 2 is a schematic sectional view of the process cartridge 2. The respective cartridges for the Y, M, C, and Bk colors are of the same configuration. The process cartridge 2 is divided into a cleaning unit 2*a* and a developing unit 2*b*.

In the cleaning unit 2*a*, an image bearing member 21 as a rotary member is rotatably mounted to a cleaning container 24. In the periphery of the image bearing member 21, there are arranged a charging roller 23 which is a primary charging unit for uniformly charging the surface of the image bearing member 21, and a cleaning blade 28 for removing the toner remaining on the image bearing member 21. In addition, there is arranged an elastomer portion (seal portion) 27 for sealing a gap between the cleaning blade 28 and the cleaning container 28 to prevent leakage of the toner stored in a waste toner chamber 30. Further, there are arranged a scooping sheet (thin plate member) 15 for scooping up the toner removed by the cleaning blade 28, and an elastomer portion (molded seal portion) 10 for fixing the scooping sheet 15 in position. Furthermore, there are arranged a charging roller cleaner 17 for cleaning the charging roller 23, and an elastomer portion 12 for fixing the charging roller cleaner 17 in position.

The developing unit 2*b* includes a developer carrying member 22 serving as a developing unit, a toner container 70 which is a developer storage portion storing a toner, and a developing container 71. The developer carrying member 22 is rotatably supported by the developing container 71. In the periphery of the developer carrying member 22, there are arranged a toner supply roller 72 which rotates in a direction of an arrow Z while in contact with the developer carrying member 22, a developer regulating member 73, a blowout prevention sheet 16, and an elastomer portion (molded seal portion) 11 for fixing the blowout prevention sheet 16 in position. Further, there is arranged an elastomer portion (seal member) 93 for sealing a gap between the developing blade unit 73 and the developing container 71 to prevent leakage of the toner in the developing container 71 to the exterior of the developing container 71. Further, a toner agitation mechanism 74 is provided inside the toner container 70.

Next, operations of the process cartridge 2 will be described. First, a toner is conveyed to the toner supply roller 72 by the toner agitation mechanism 74 which rotates in a direction of an arrow X in FIG. 2. The toner supply roller 72 rotates in the direction of the arrow Z in FIG. 2, so that the toner is supplied to the developer carrying member 22. The toner supplied onto the developer carrying member 22 reaches the developer regulating member (developing blade unit) 73 by rotation of the developer carrying member 22 in a direction indicated by an arrow Y. The developer regulating member 73 regulates the toner to apply a predetermined charging electric load amount thereto, and forms a predetermined thin layer of toner. The toner regulated by the developer regulating member 73 is conveyed to a developing portion where the image bearing member 21 and the developer carrying member 22 are held in contact with each other, and the toner is developed by the image bearing member 21 by a developing bias applied to the developer carrying member 22. After the toner used for the development on the image bearing member 22 has been primarily transferred to the intermediate transfer member 35, a waste toner remaining on the image bearing member 21 is removed by the cleaning blade 28. The removed waste toner is collected in the waste toner chamber (developer storage portion) 30.

(Cleaning Unit)

Figure 3:
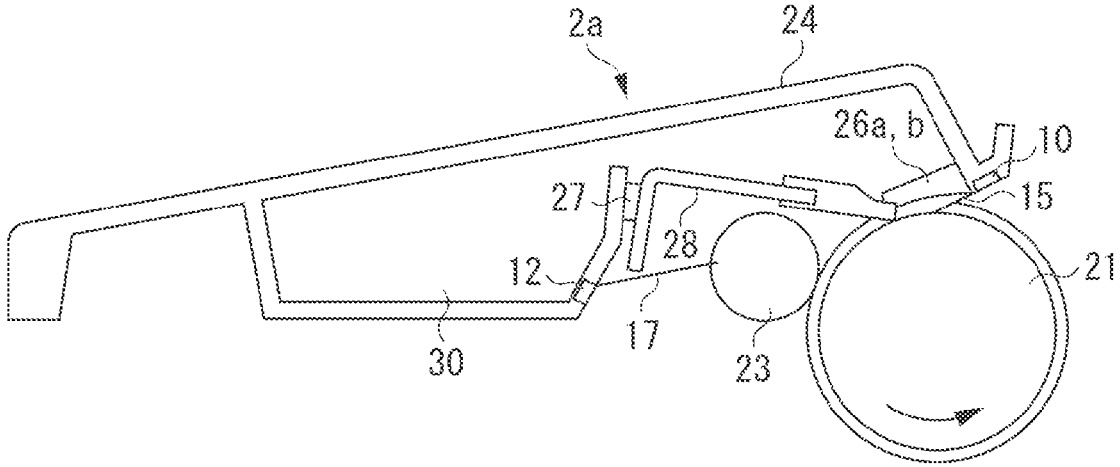
FIG. 3 is a schematic structural sectional view illustrating a cleaning member and an image bearing member.
Figure 4:
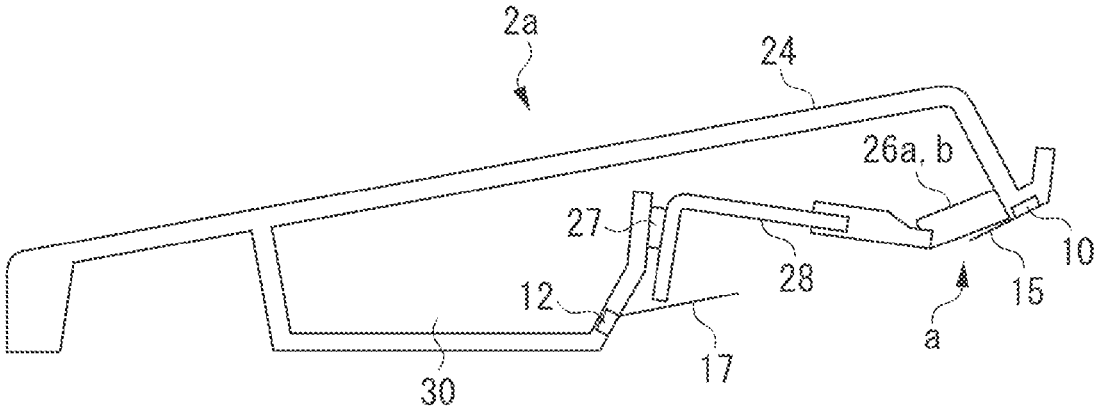
FIG. 4 is a schematic sectional view illustrating a configuration of a cleaning member of a cleaning unit.
Figure 5:
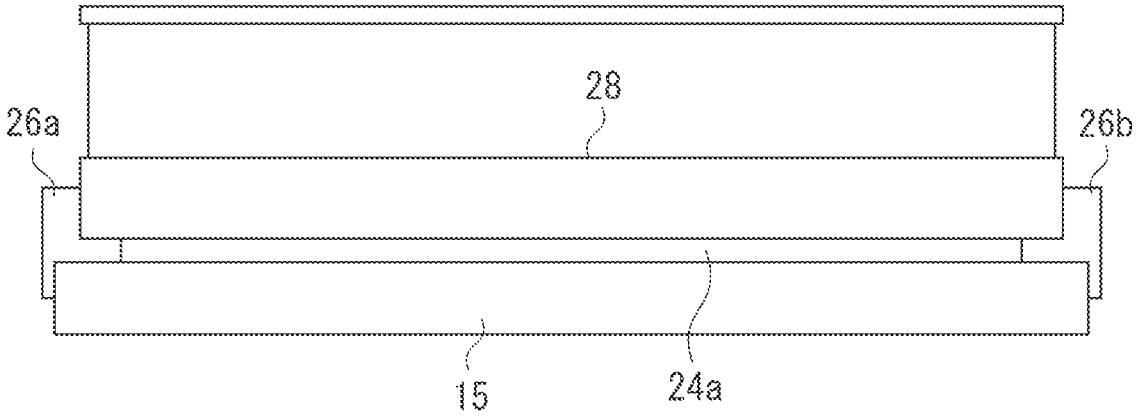
FIG. 5 is a structural explanatory diagram as seen from a direction of an arrow a in FIG. 4.

Referring to FIGS. 3 through 5, the configuration of the cleaning unit 2*a* will be described. FIG. 3 is a schematic structural sectional view illustrating the cleaning member and the image bearing member 21. FIG. 4 is a schematic sectional view illustrating the configuration of the cleaning member. FIG. 5 is a structural explanatory diagram of the cleaning unit as seen from the direction of an arrow a in FIG. 4.

As illustrated in FIGS. 3 and 4, there are provided the cleaning blade 28 for scraping off any residual substance such as waste toner from the image bearing member 21, and the scooping sheet 15 for scooping up the residual substance that has been scraped off. In addition, the waste toner chamber 30, which is a developer storage portion for storing residual substance, includes image bearing member end portion seal members 26*a* and 26*b* arranged at both end portions of the cleaning blade 28, and an elastomer portion 27 provided between the cleaning blade and the cleaning container 24. These members are incorporated into the cleaning container 24 to form the cleaning unit 2*a*.

More specifically, as illustrated in FIG. 5, the cleaning blade 28 and the scooping sheet 15, which is a sheet member, are held in contact with an outer peripheral surface of the image bearing member 21 at positions where they do not interfere with each other, and form an opening 24*a*. The scooping sheet 15 is heat-welded to the elastomer portion 10 formed on the cleaning container 24 as the seal member of the scooping sheet 15. The image bearing member (described in detail below) is arranged at the opening of the cleaning container 24. The scooping sheet 15 is provided in order to prevent leakage of the toner from a gap between the cleaning container 24 and the image bearing member 21 by coming into contact with the image bearing member 21. Further, as illustrated in FIG. 5, the image bearing member end portion seal members 26*a* and 26*b* are arranged using the cleaning blade 28 as a reference. Further, they are held in contact with both end portions of the scooping sheet 15, and are also held in contact with the outer peripheral surface of the image bearing member 21 as illustrated in FIG. 3. In addition, the gap between the cleaning blade 28 and the cleaning container 24 is hermetically sealed by the elastomer portion 27.

There is provided a charging roller cleaner 17 for cleaning the charging roller 23. The charging roller cleaner 17 is heat-welded to the elastomer portion 12 formed on the cleaning container 24 as the seal member of the charging roller cleaner 17.

(Developing Unit)

Figure 6:
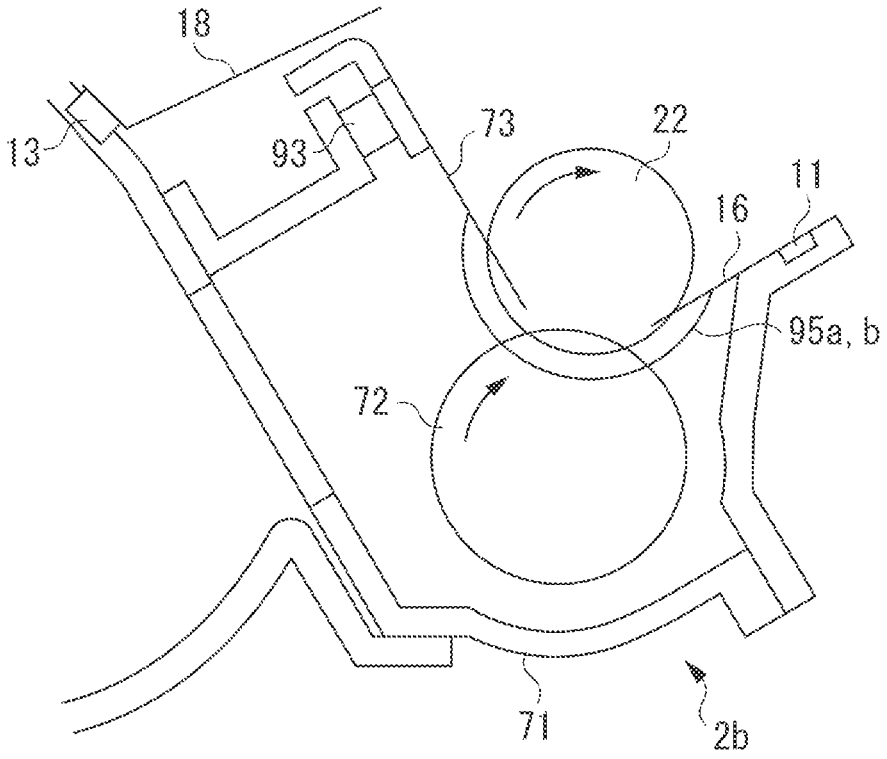
FIG. 6 is a schematic structural sectional view illustrating a configuration of each portion of a developing unit.
Figure 7:
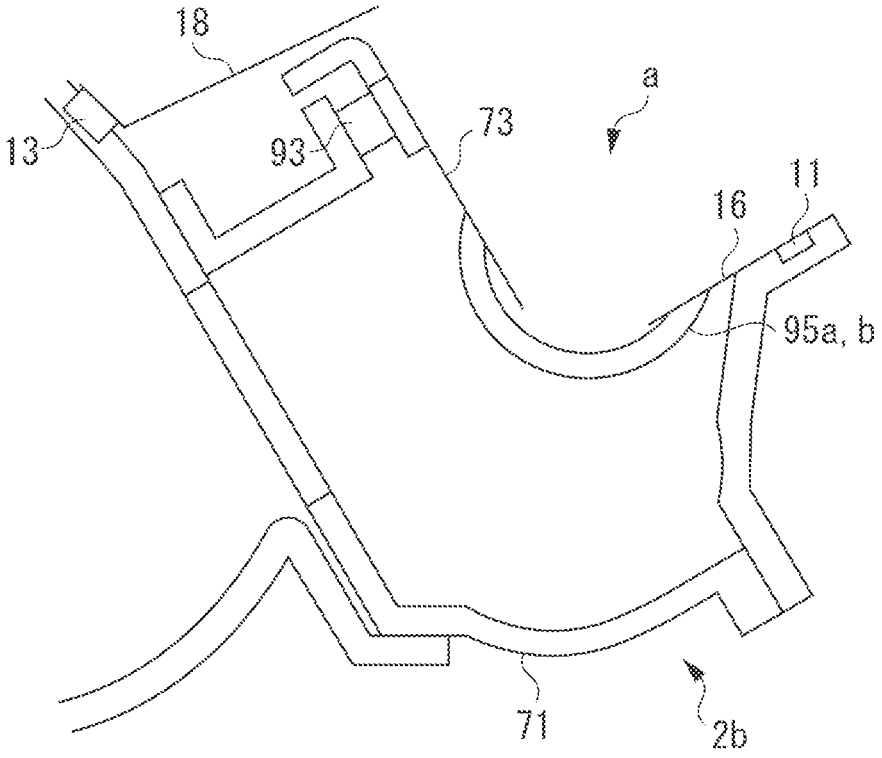
FIG. 7 is a schematic sectional view illustrating a configuration of each portion of the developing unit.
Figure 8:
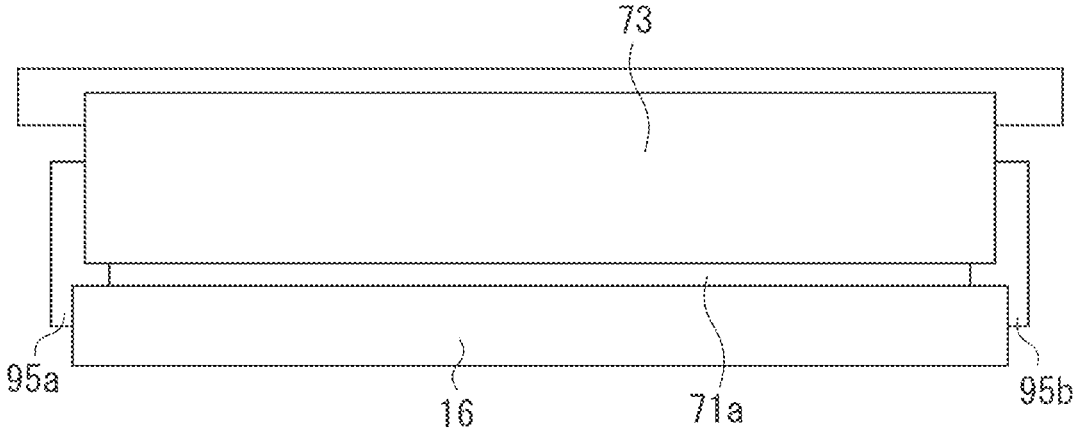
FIG. 8 is a structural explanatory diagram as seen from a direction of an arrow a in FIG. 6.

The configuration of the developing unit 2*b* will be described with reference to FIGS. 6 through 8. FIG. 6 is a schematic structural sectional view illustrating the blowout prevention sheet 16, the developing blade unit 73, developer carrying member end portion seal members 95*a* and 95*b*, and the developer carrying member 22. FIG. 7 is a schematic sectional view illustrating the configuration of the blowout prevention sheet 16, the developing blade unit 73, and the developer carrying member end portion seal members 95*a* and 95*b*. FIG. 8 is a structural explanatory diagram of the configuration as seen from a direction of an arrow a in FIG. 7.

As illustrated in FIGS. 6 and 7, there are provided the developing blade unit 73 for making even the toner of the developer carrying member 22, and the blowout prevention sheet 16 which is a sheet member for preventing the toner from blowing out between the developer carrying member 22 and the developer container 71. Further, there are provided the developer container 71 for storing toner, the developer carrying member end portion seal members 95*a* and 95*b* arranged at both end portions of the developing blade unit 73 in order to prevent leakage of the toner from the developer container 71, and the elastomer portion 93 provided between the developing blade unit 73 and the developing container 71. These members are incorporated into the developing container 71 to form the developing unit 2*b*.

More specifically, as illustrated in FIG. 8, the developing blade unit 73 and the blowout prevention sheet 16 are held in contact with the outer peripheral surface of the developer carrying member 22 at positions where they do not interfere with each other, and form an opening 71*a*. The blowout prevention sheet 16 is heat-welded to the elastomer portion 11 formed on the developing container 71 as the seal member of the blowout prevention sheet 16 (as described in detail below). As illustrated in FIG. 8, the developer carrying member end portion seal members 95*a* and 95*b* are held in contact with both end portions of the developing blade unit 73 and the blowout prevention sheet 16, and are also held in contact with the outer peripheral surface of the developer carrying member 22 as illustrated in FIG. 6. The elastomer portion 93 hermetically closes the gap or the like between the developing blade unit 73 and the developing container 71.

A scattering prevention sheet 18 is provided to prevent the toner from scattering. The scattering prevention sheet 18 is heat-welded to the elastomer portion 13 formed on the developing container 71 as the seal member of the scattering prevention sheet 18.

(Formation of Elastomer Portion)

Figure 9A:
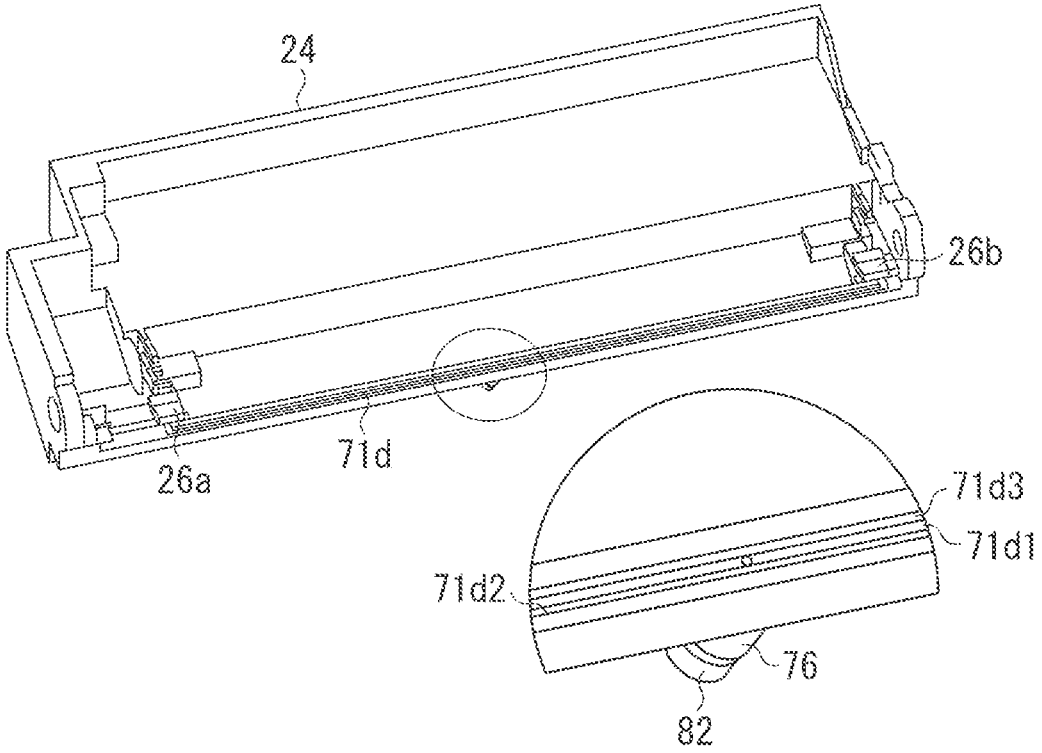
FIGS. 9A through 9D are explanatory diagrams illustrating the formation of an elastomer portion.
Figure 9B:
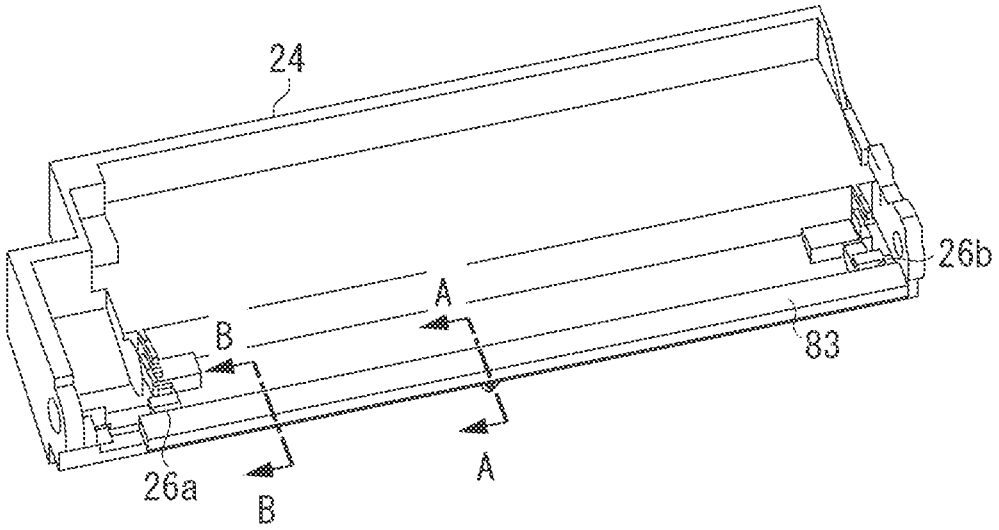
Figure 9C:
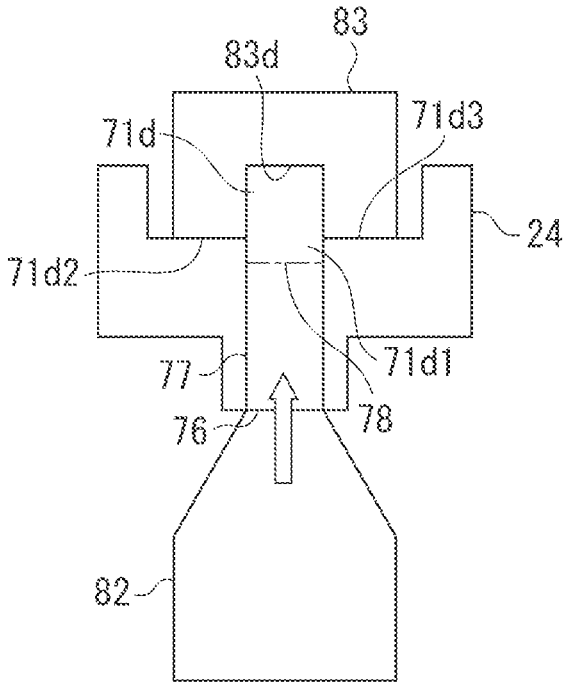
Figure 9D:
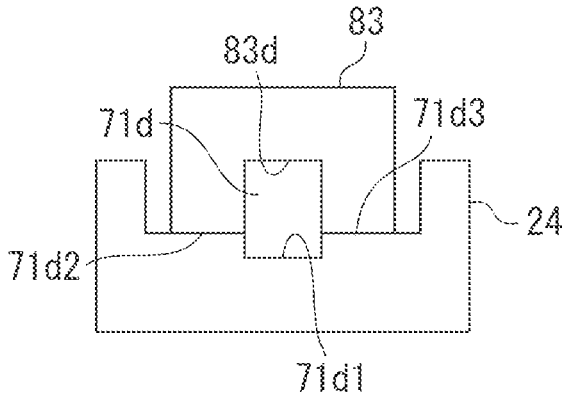
Figure 10:
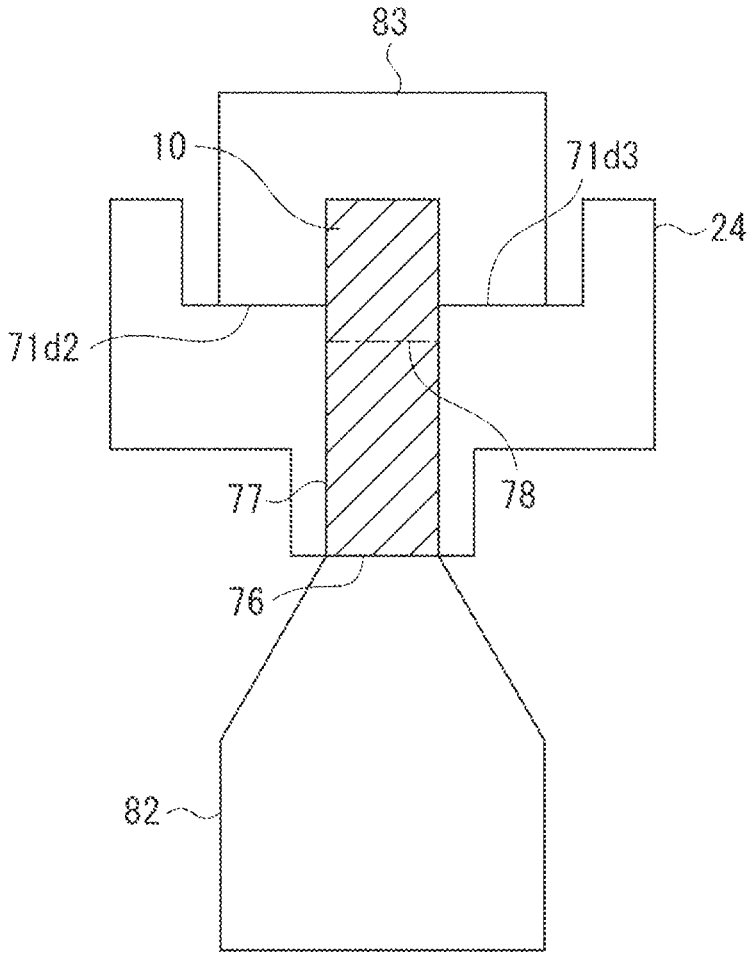
FIG. 10 is a schematic sectional view taken along a line A-A in FIG. 9B.
Figure 11:
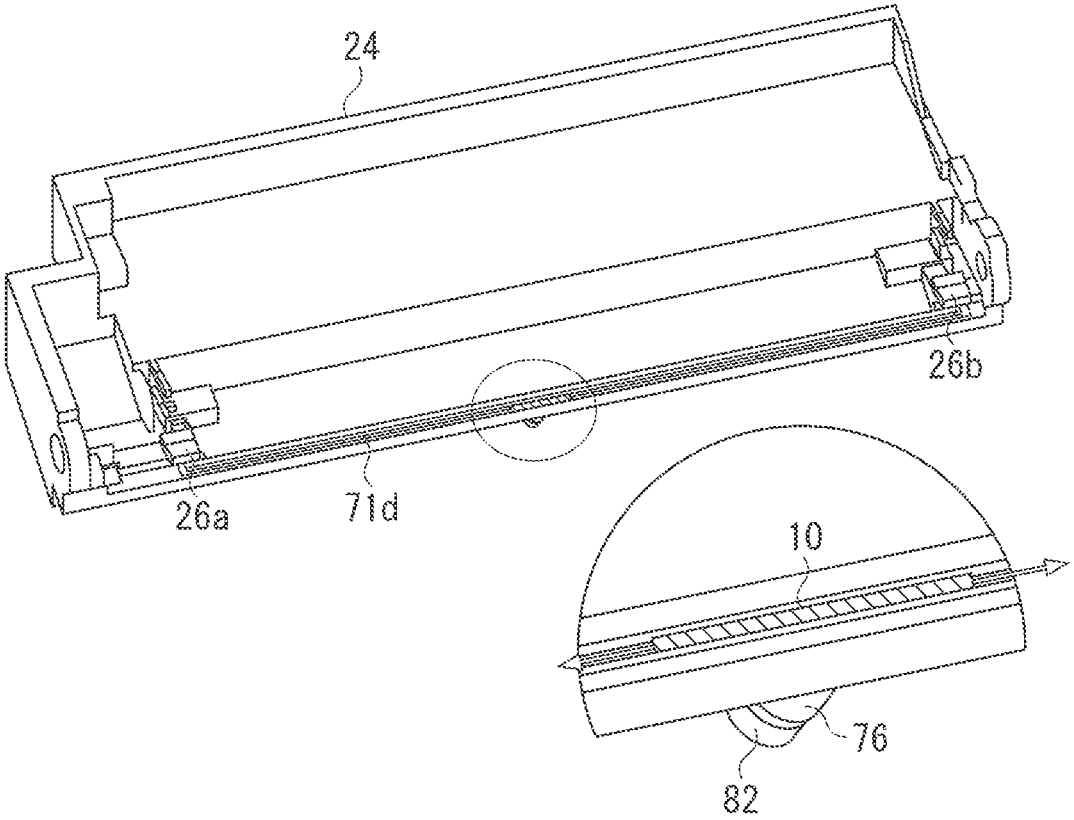
FIG. 11 is a schematic diagram illustrating how an elastomer portion is formed.

The process for forming the elastomer portion 10 will be described with reference to FIGS. 9 through 11. FIGS. 9A through 9D illustrate the formation of the elastomer portion as the seal member. FIG. 9A includes a schematic diagram illustrating the cleaning container 24 and a schematic enlarged view of the injection port portion. FIG. 9B is a schematic diagram illustrating the state in which a mold 83 is clamped on the cleaning container 24. FIG. 9C is a schematic sectional view taken along a line A-A in FIG. 9B. FIG. 9D is a schematic sectional view taken along a line B-B in FIG. 9B. FIG. 10 is a schematic sectional view taken along the line A-A in FIG. 9B, illustrating how the elastomer portion 10 is formed. FIG. 11 is a schematic diagram illustrating how the elastomer portion 10 is formed.

As illustrated in FIGS. 9A through 9D, an elastomer portion forming portion 71*d* is provided between the image bearing member end portion seal member 26*a* at one end side of the cleaning container 24 and the image bearing member end portion seal member 26*b* at the other end side thereof. The elastomer portion forming portion 71*d* includes a recess portion 71*d*1 which is a seal forming portion into which the elastomer portion 10 is injected and contact surfaces 71*d*2 and 71*d*3 held in contact with the mold. At a predetermined position in the longitudinal direction, there is provided an injection path 77 which has a cylindrical configuration and communicates with the recess portion 71*d*1 of the elastomer portion forming portion 71*d*. An injection port 76 is provided at one end side of the injection path 77, and a discharge port 78 is provided at the other end side thereof. In a direction orthogonal to a bottom surface of a recess portion 83*d* which is a seal forming portion, the injection port 76 is provided on the back side of the bottom surface of the recess portion 83*d*.

Next, a method for forming the elastomer portion 10 will be described. As illustrated in FIG. 9A, according to the present exemplary embodiment, the injection port 76 is provided at one position in the central portion in the longitudinal direction of the elastomer portion forming portion 71*d*. However, it is also possible to provide the injection port at two or more positions. As illustrated in FIGS. 9C and 9D, when the elastomer portion 10 is formed, the mold 83 is brought into contact with the contact surfaces 71*d*2 and 71*d*3 of the elastomer portion forming portion 71*d* of the cleaning container 24. The mold 83 includes the recess portion 83*d* which is shaped into the shape of the elastomer portion 10, that is, which has a shape corresponding to an outer shape of the elastomer portion 10. Next, a gate 82 of a resin injection device is brought into contact with the injection port 76 provided at one longitudinal central position of the cleaning container 24. Then, a molten resin (i.e., a thermoplastic elastomer) to be formed into the elastomer portion 10 is injected from the gate 82 of the resin injection device into the injection port 76 of the cleaning container 24 in the direction of an arrow in FIG. 9C.

As illustrated in FIG. 10, the injected molten resin passes through the injection path 77 to be injected from the discharge port 78 into a space formed by the mold 83 and the recess portion 71*d*1 which is the seal forming portion. As illustrated in FIG. 11, the molten resin injected from the one longitudinal central portion flows through the forming spaces formed by the recess portion 71*d*1 of the elastomer portion forming portion 71*d* and the recess portion 83*d* of the mold 83 to both sides in the longitudinal direction. In this way, injection molding is performed with the thermoplastic resin in the forming space formed by bringing the mold into contact with the cleaning container 24, so that the elastomer portion 10 is formed integrally with the cleaning container 24.

The elastomer portion is formed integrally with the cleaning container 24. According to the present exemplary embodiment, a styrene system elastomer resin is employed as the material of the elastomer portion 10. The cleaning container 24 is formed of high impact polystyrene (HI-PS) resin, so that it is desirable for the elastomer resin to be of a material in the same system as the cleaning container 24 such as an elastic styrene system elastomer resin. If they are components of the same material, there is no need to effect decomposition between components, and it is superior decomposition operability at the time of recycling of the process cartridge. Some other elastomer resins may be employed so long as it exhibits similar mechanical characteristics.

The above-described method for forming the elastomer portion 10 on the cleaning container 24 is also applicable to the formation of the elastomer portion 11, 13, or 93 on the developing container 71, and to the formation of the elastomer portion 12 or 27 on the cleaning container 24. Regarding the formation of the elastomer portion 10, 11, 12, 13, 27, or 93, it is also possible to form it on a frame member such as the cleaning container 24 or the developing container 71 through two-color molding, insert molding or the like in addition to the above-described method.

(Positional Relationship Between Elastomer Portion and Injection Port)

A positional relationship between an elastomer portion 110 integrally formed on a cleaning container 124 or a developing container 171 (hereinbelow referred to as a frame member) and an injection port 176 will be described with reference to FIGS. 12 and 13.

FIGS. 12A through 12E are a schematic diagram and schematic sectional views illustrating a comparative example in which the central axis in the injection direction of an injection path 177 of the elastomer portion 110 is arranged within an opening diameter OD of the injection port 176 (hereinbelow expressed as "within the injection port") (i.e., not deviated). The diagrams also illustrate the sink mark in this case.

FIGS. 13A through 13H are a schematic diagram and schematic sectional views illustrating the present exemplary embodiment in the case in which the central axis of the injection path 77 of the elastomer portion 10 is deviated from within the injection port 76. The diagrams also illustrate the sink mark in this case.

Figure 12A:
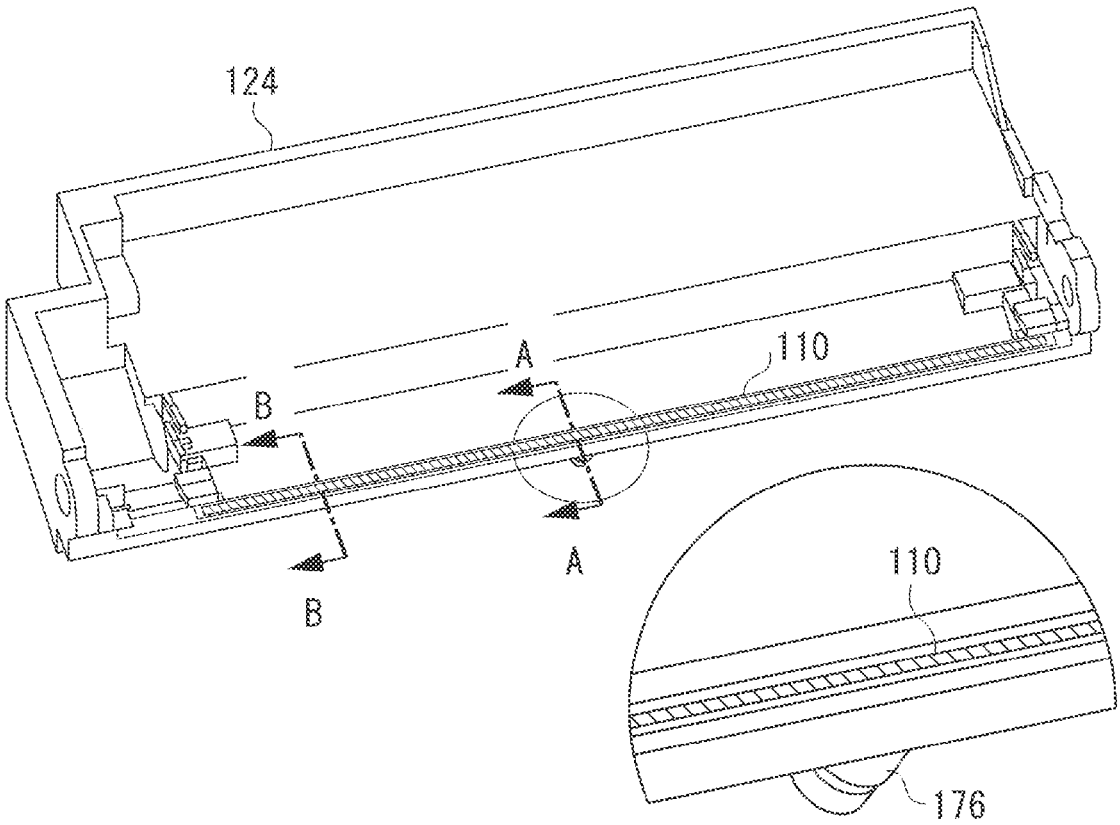
FIGS. 12A through 12E are schematic diagrams illustrating an injection port as arranged in alignment with a molding.
Figure 12B:
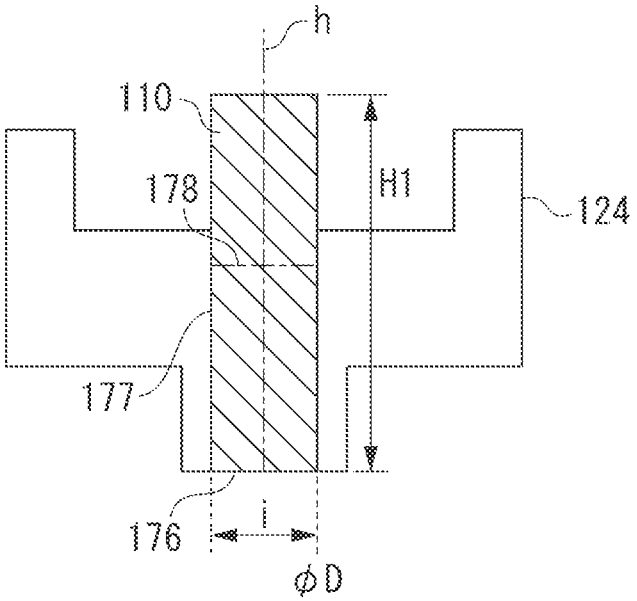
Figure 12C:
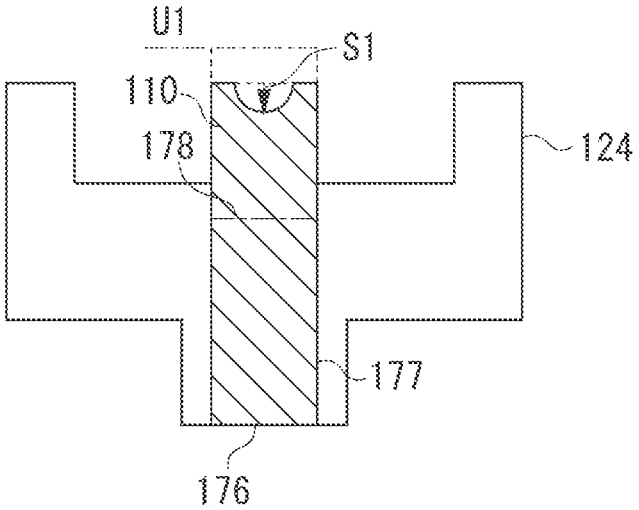
Figure 12D:
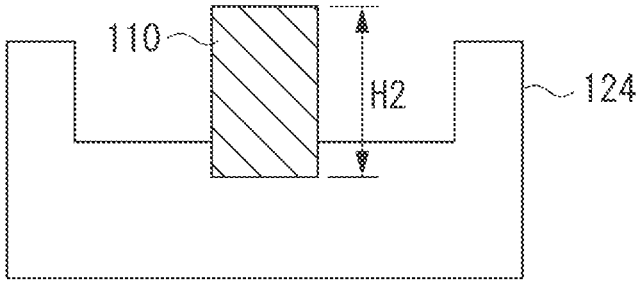
Figure 12E:
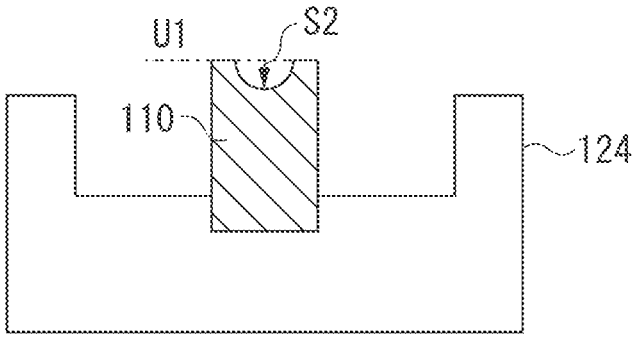

As illustrated in FIGS. 12A through 12E, the injection port 176 and the elastomer portion 10 are in a front/back relationship with respect to the cleaning container 24. In the following, each case will be described. Generally speaking, when injection molding is performed with thermoplastic resin, a sink mark may be generated on a surface of the molding depending upon a thickness of the molding. In view of this, immediately after the molding, the elastomer portion 110 is formed as illustrated in FIGS. 12B and 12D. However, with the passage of time, the elastomer portion 110 is cooled, with the result that a sink mark is generated as illustrated in FIGS. 12C and 12E. At this time, a relationship between sinking amounts S1 and S2 is as follows: S1>S2. In addition, in a cross section of the injection port, a predetermined molding height U1 cannot be attained due to the sink mark.

In view of this, as illustrated in FIGS. 13A through 13H, according to the present exemplary embodiment, the discharge port 78 and the injection port 76 are arranged so as to be deviated from each other in a direction orthogonal to the bottom surface of the recess portion 83*d*, which is the seal forming portion, whereby the thickness of the elastomer portion 10 is partially reduced. As a result, a sink mark is not easily generated on the surface of the elastomer portion 10, and the predetermined molding height U1 can be secured.

Figure 13A:
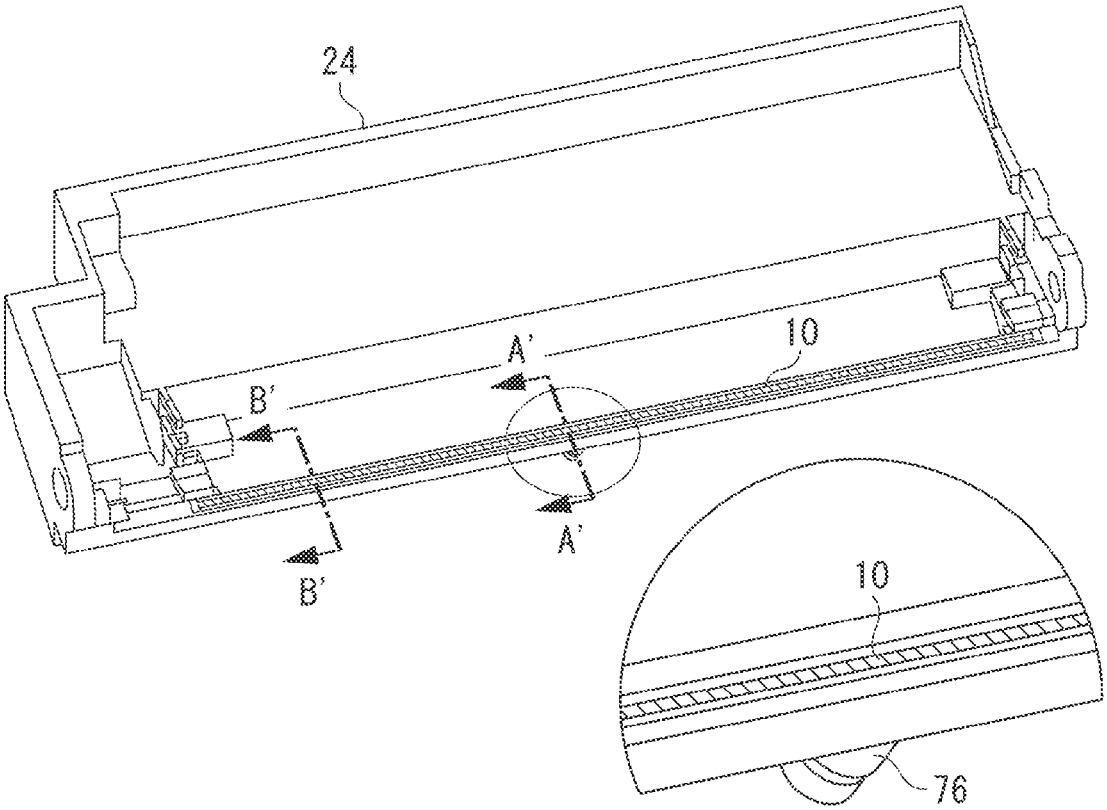
FIGS. 13A through 13H are schematic diagrams illustrating an injection port as arranged so as to be deviated from a molding.
Figure 13B:
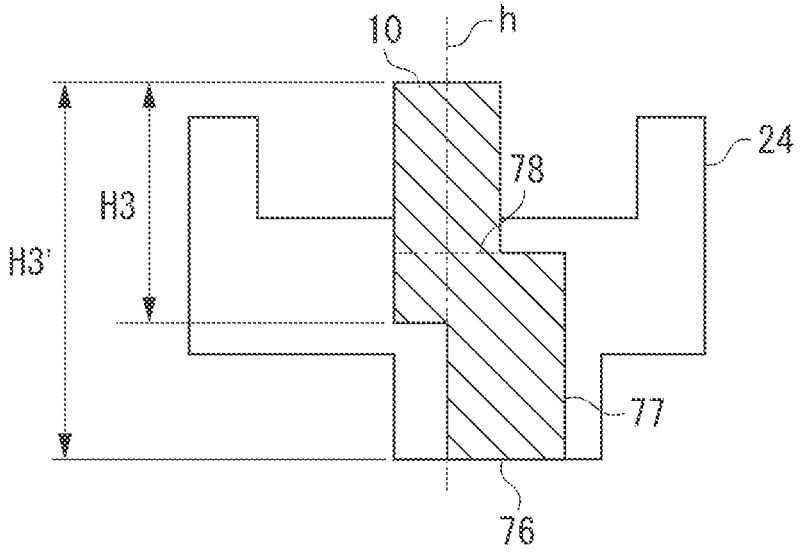
Figure 13C:
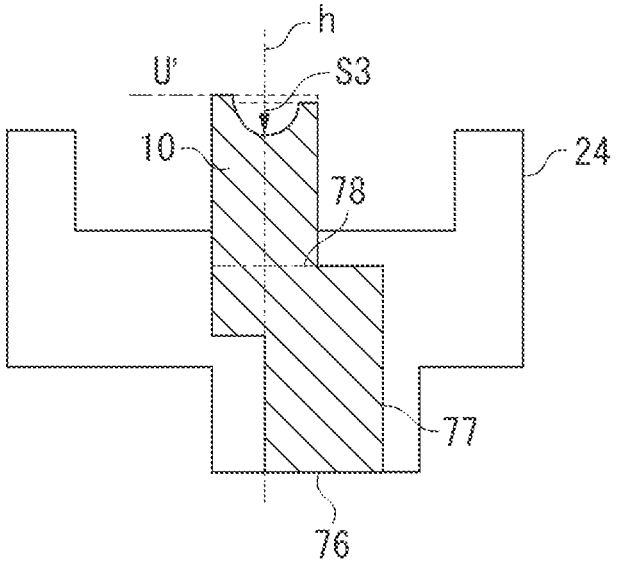
Figure 13D:
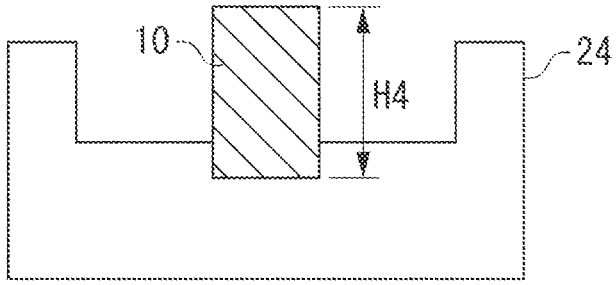
Figure 13E:
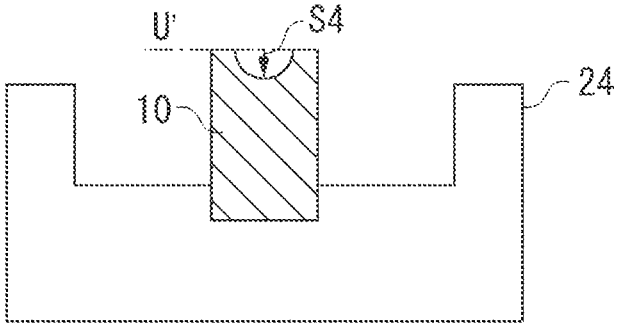

More specifically, when the elastomer portion 10 is formed as illustrated in FIGS. 13B and 13D, a sink mark is generated at a molding height H3' portion overlapping the injection port 76 as in the case in FIG. 12C, whereas, at a molding height H3 portion, the generation of a sink mark is suppressed, making it possible to attain the predetermined molding height U1.

Figure 13F:
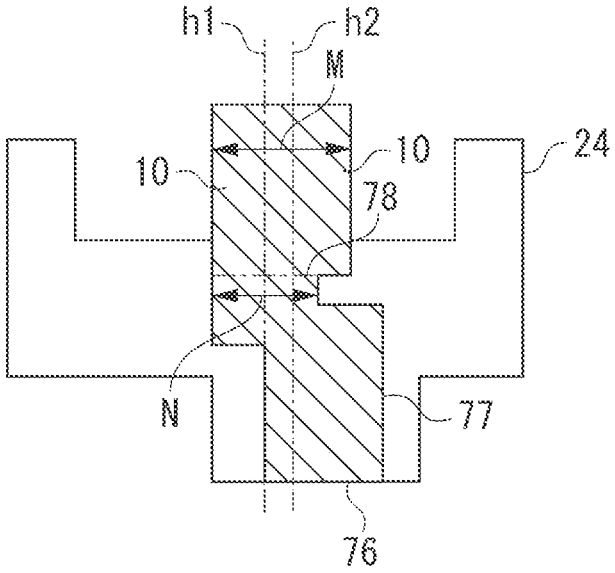

Further, as illustrated in FIG. 13F, also in the case where a flow path is enlarged on the downstream side of the injection path 77 (N<M), the central axis h1 of the flow path N is not in the injection port 76, so that the generation of a sink mark is suppressed as in the case in FIG. 13C.

Figure 13G:
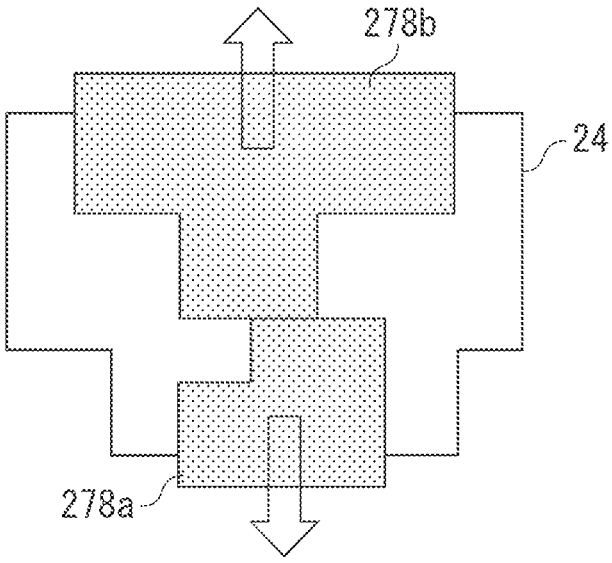
Figure 13H:
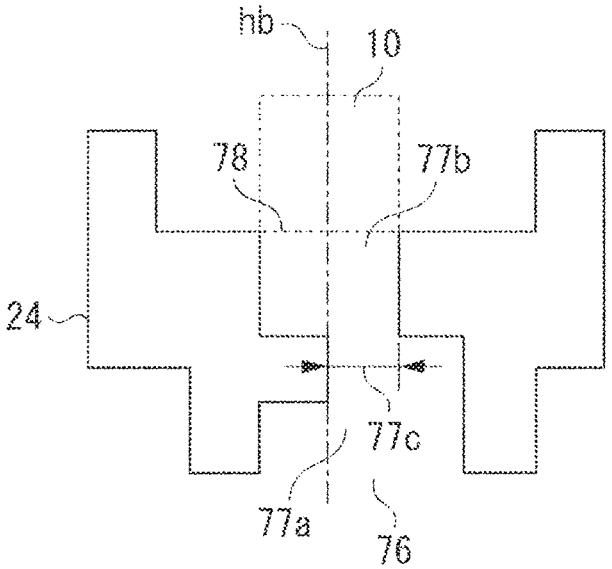

Further, as illustrated in FIG. 13G, in another mode of the present exemplary embodiment, after the formation of the cleaning container 24, a first mold 278*a* and a second mold 278*b* are retracted in the direction of arrows in the drawing. Accordingly, as illustrated in FIG. 13H, it is possible to obtain a first injection path 77*a* on the injection port 76 side and a second injection path 77*b* on the side where the elastomer portion 10 is formed. At this time, as illustrated in FIG. 13H, at a border portion between the first injection path 77*a* and the second injection path 77*b*, there is formed a flow path 77*c* where the sectional area of the injection path is minimum. The flow path 77*c* is naturally situated on the upstream side of the discharge port 78 in the injection direction of the molten resin. In addition, since the central axis hb of the discharge port 78 is not within the narrowest flow path 77*c*, it is possible to suppress the generation of a sink mark as in the case in FIG. 13C.

The above-described positional relationship between the elastomer portion 10 and the injection port 76 is also applicable to the formation of the elastomer portion 11, 13, or 93 on the developing container 71 and to the formation of the elastomer portion 12 or 27 on the cleaning container 24.

(Sealing of Toner)

The configuration for sealing the toner according to the present exemplary embodiment will be described with reference to FIGS. 14A through 14C.

Figure 14A:
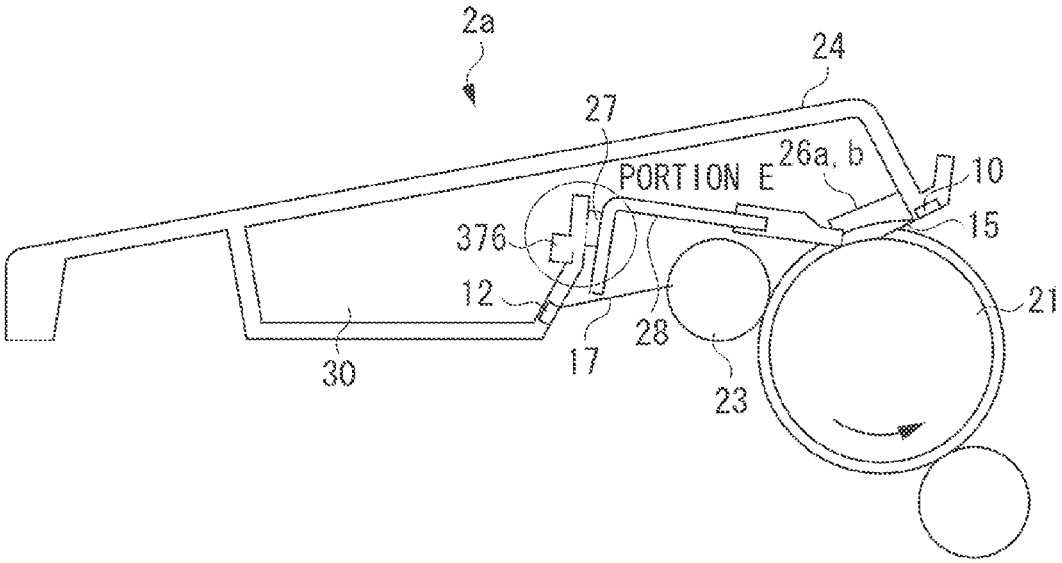
FIGS. 14A through 14C are structural explanatory diagrams illustrating an elastomer portion as used as a toner seal member.

FIG. 14A is a schematic sectional view of the cleaning unit 2*a*. FIG. 14B is a partial enlarged view of a portion E where the elastomer portion 27 is formed on the cleaning container 24 before mounting of the cleaning blade 27. FIG. 14C is a partial enlarged view of the portion E when the cleaning blade 27 is attached thereto.

Figure 14B:
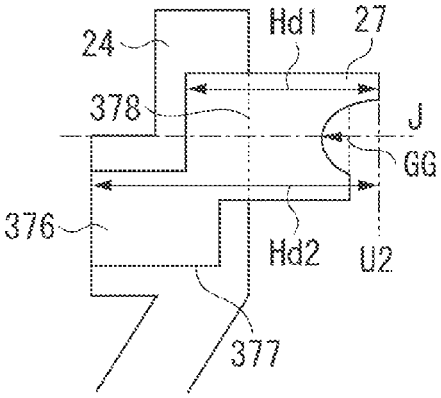
Figure 14C:
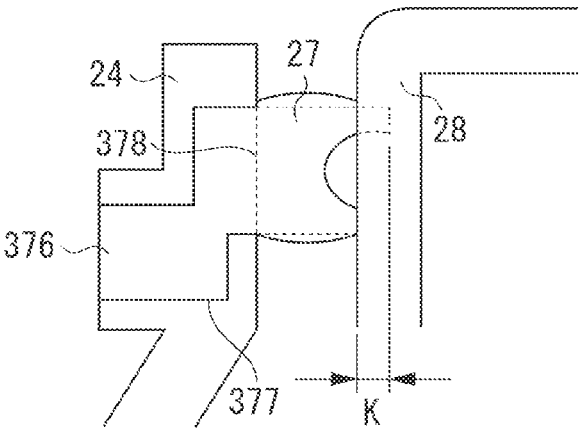

As illustrated in FIG. 14B, by forming the elastomer portion 27, a sink mark GG is generated at a molding height Hd2 portion overlapping an injection port 376. However, at a molding height Hd1 portion where the central axis in the resin flowing direction of an injection port 377 is deviated from within the injection port 376, the generation of a sink mark is suppressed, and it is possible to secure a molding height U2 necessary for sealing the toner. Thus, when the cleaning blade 28 is mounted as illustrated in FIG. 14C, it is possible for the elastomer portion 27 to attain a predetermined crushing amount K. This configuration is also applied to the case where the elastomer portion 93 is formed into the developing container 71, and the developing blade unit 73 is mounted thereto.

Next, a case where the elastomer portion 10, 11, 12, or 13 is heat-welded to a sheet will be described.

(Sheet Welding)

Figure 15A:
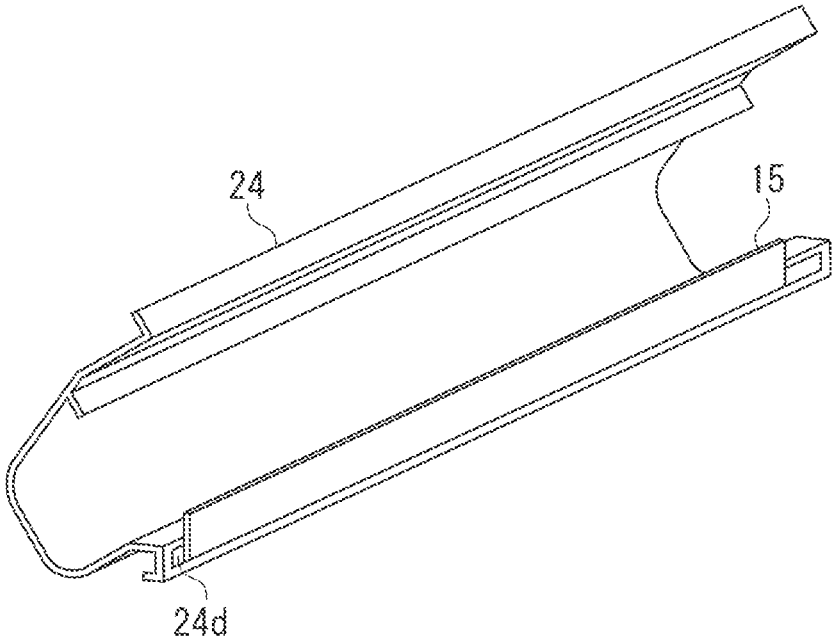
FIGS. 15A and 15B are schematic structural views illustrating a cleaning container to which a scooping sheet is mounted.
Figure 15B:
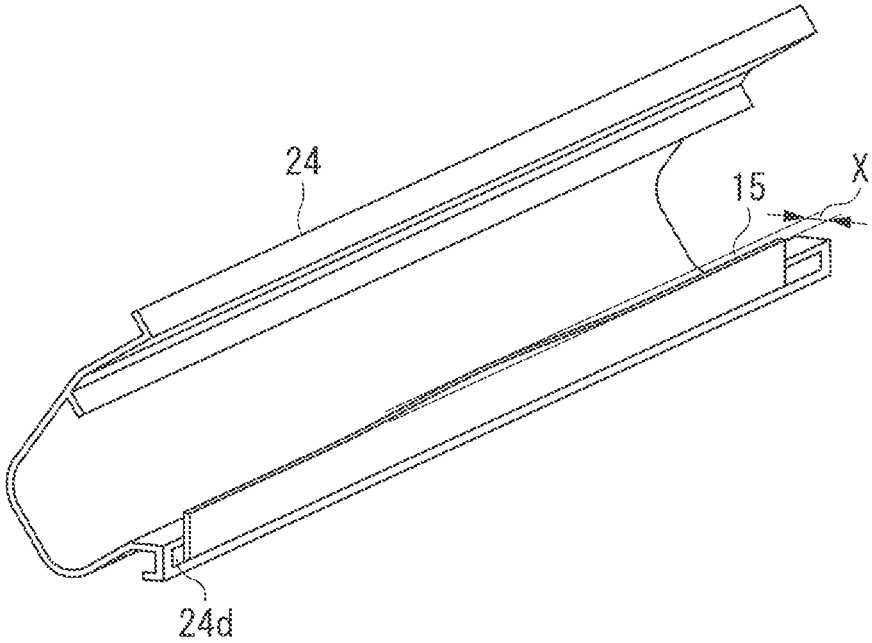
Figure 16A:
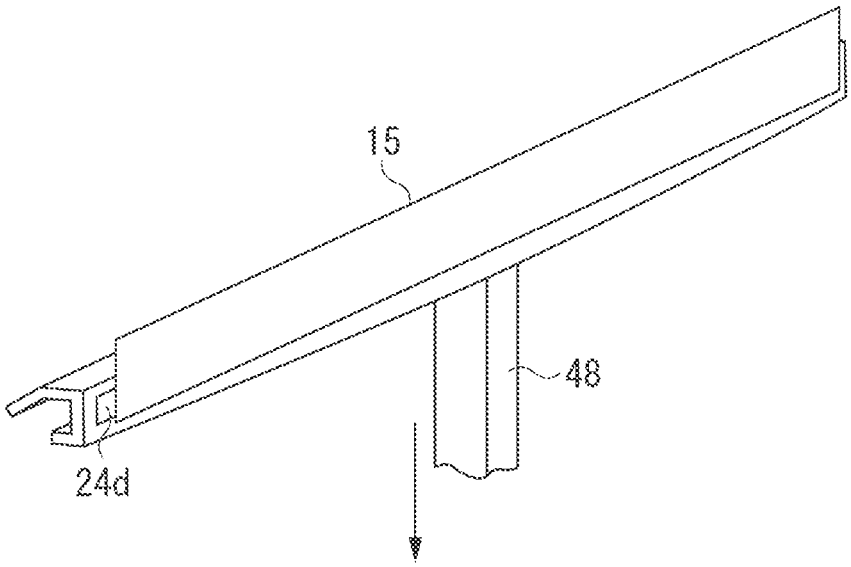
FIGS. 16A and 16B are explanatory diagrams illustrating a method for applying tension to an upper end of a scooping sheet.
Figure 16B:
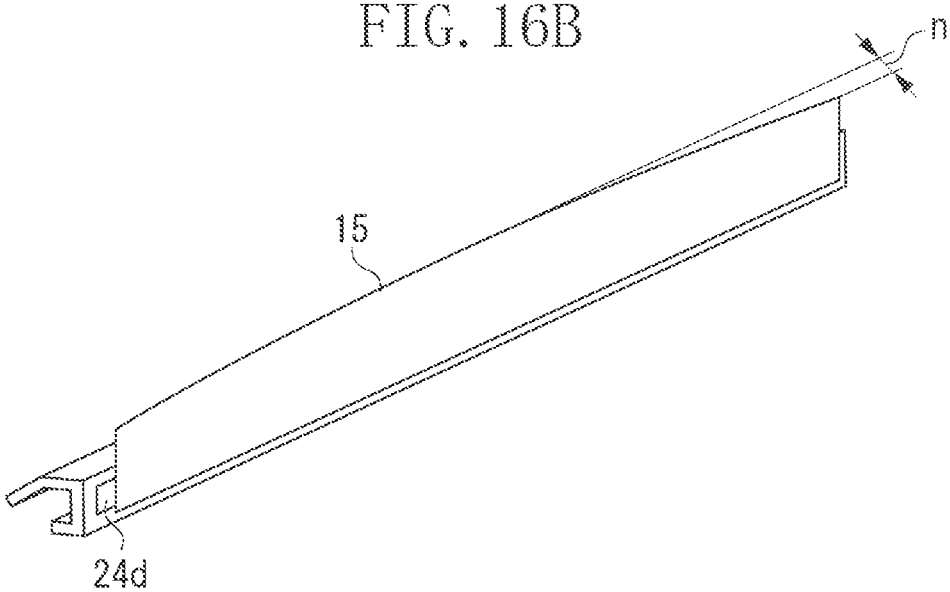
Figure 17:
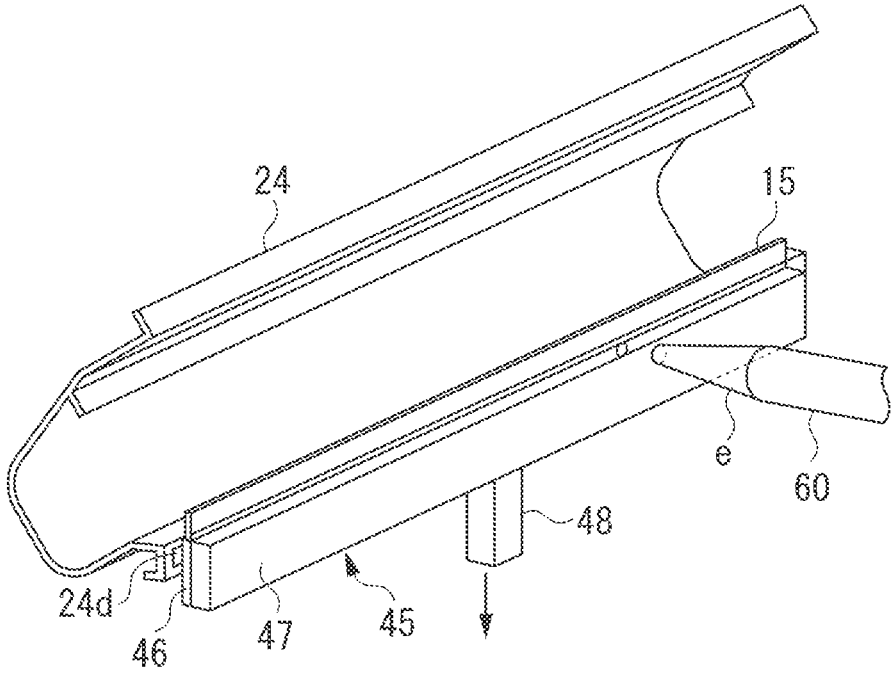
FIG. 17 is an explanatory diagram illustrating how an elastomer portion is melted to weld a sheet.
Figure 18:
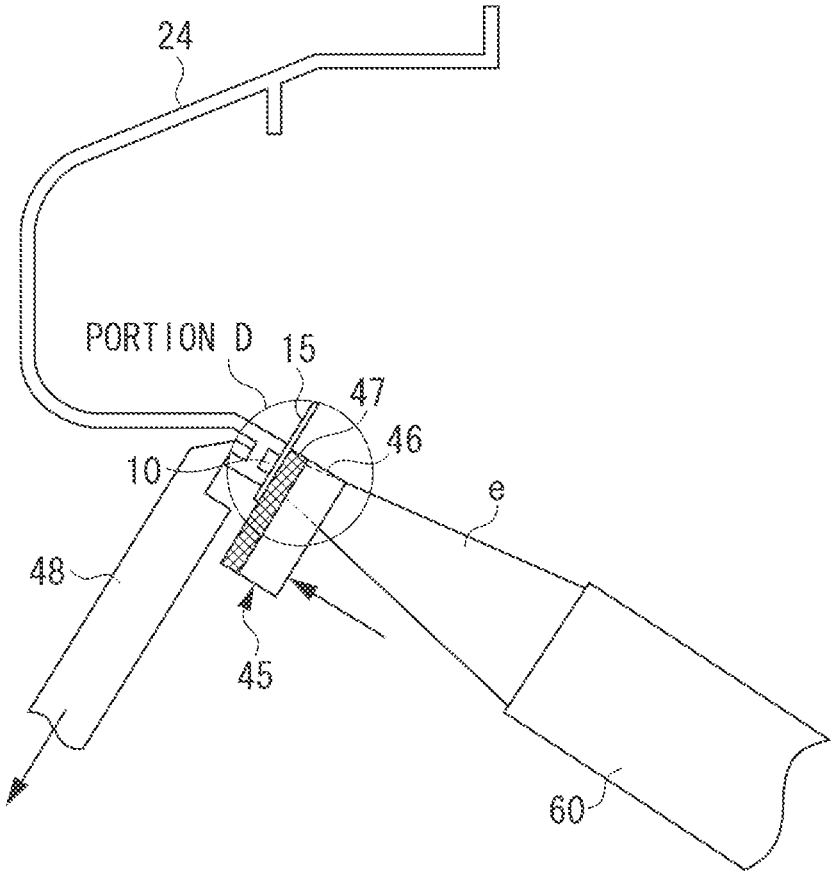
FIG. 18 is a sectional view of a portion illustrated in FIG. 17.
Figure 19A:
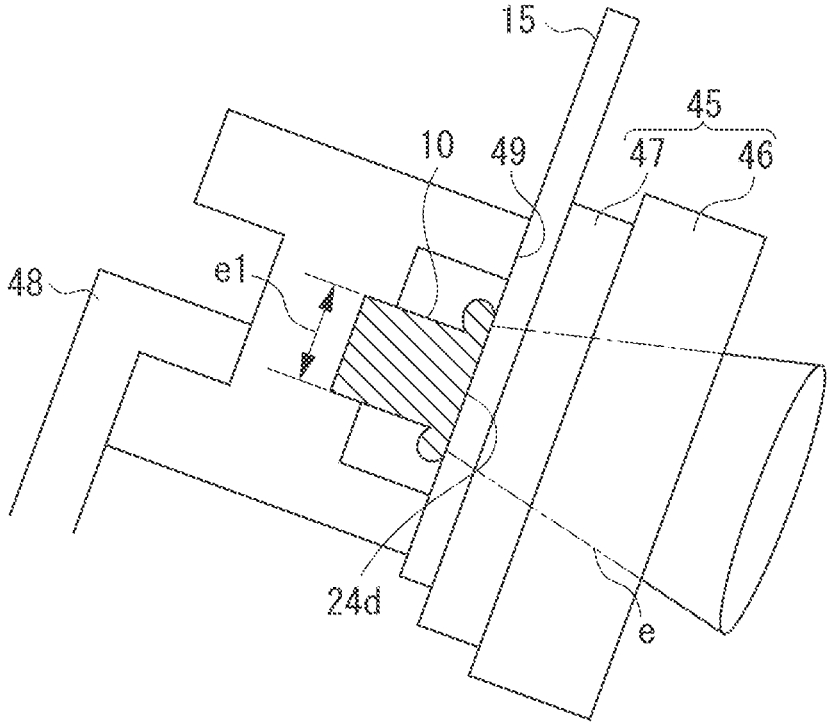
FIGS. 19A through 19C are partial enlarged views of a portion D in FIG. 18. They are diagrams illustrating a scooping sheet after welded.
Figure 19B:
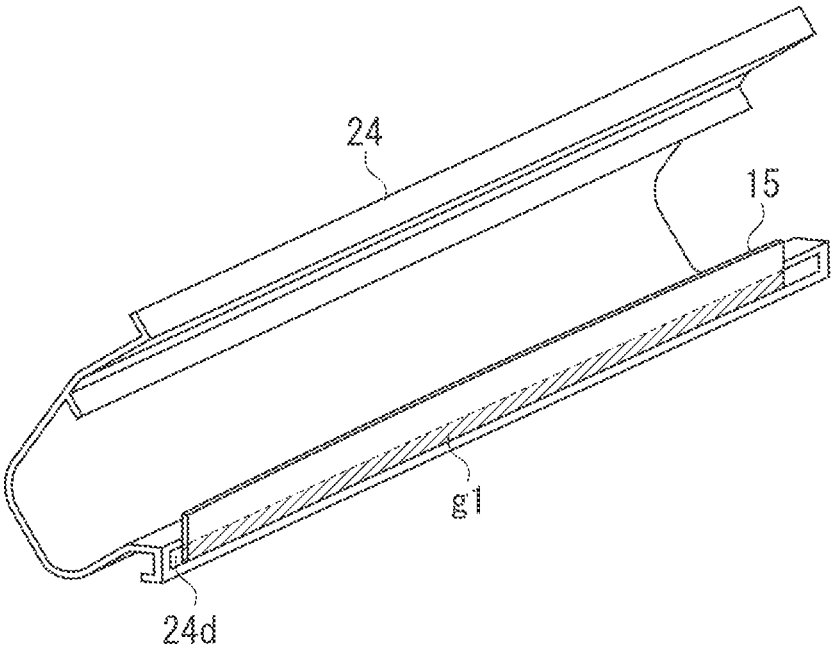
Figure 19C:
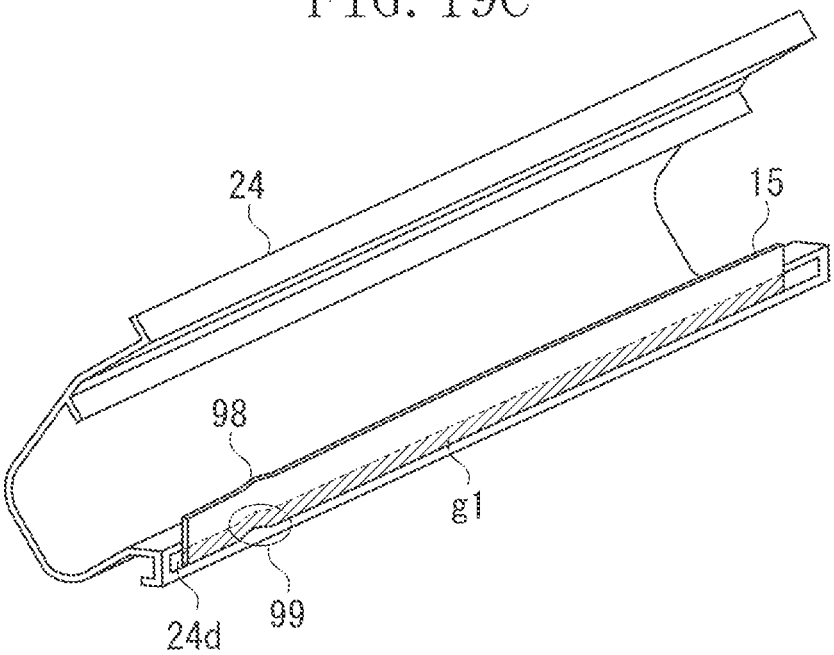
Figure 20:
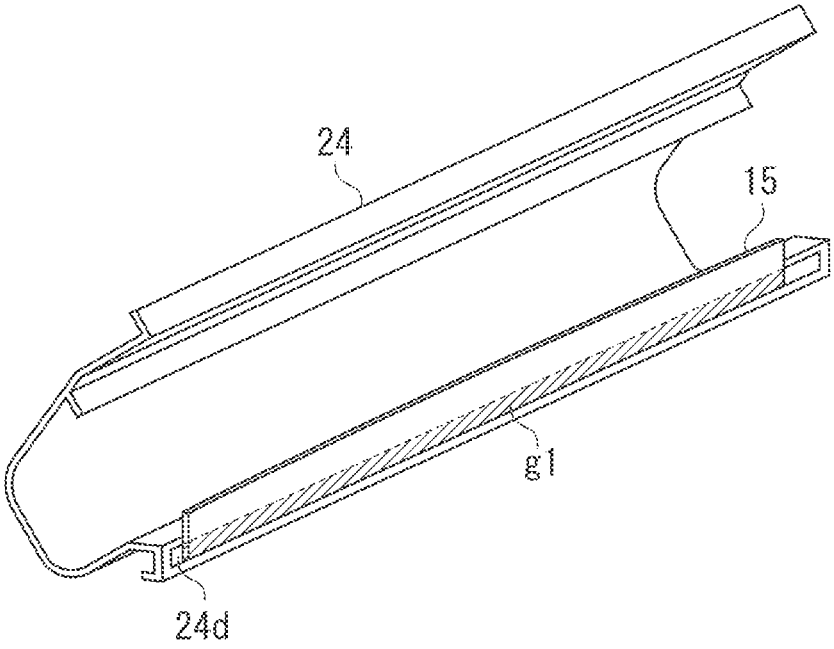
FIG. 20 is an explanatory diagram illustrating a cleaning container to which a scooping sheet has been welded.

Referring to FIGS. 15 through 20, a process for welding a sheet member according to the exemplary embodiment of the present invention will be described in connection with a case where a semiconductor laser is employed. FIGS. 15A and 15B are schematic structural diagrams of a cleaning container to which a scooping sheet, which is a sheet member, is mounted. FIG. 15A illustrates a state in which no undulation has been generated in the scooping sheet 15, and FIG. 15B illustrates a state in which a leading edge of the scooping sheet 15 has been undulated. FIGS. 16A and 16B illustrate a method for applying tension to an upper end of the scooping sheet. FIG. 16A illustrates a state in which a sheet mounting surface 24*d* of the cleaning container 24 has been curved by a pulling jig 48. FIG. 16B illustrates how tension is applied to the upper end of the scooping sheet 15 by releasing the curving of the sheet mounting surface 24*d* of the cleaning container 24. FIG. 17 is an explanatory diagram illustrating how the scooping sheet 15 is heat-welded by melting the elastomer portion 10 formed on the cleaning container 24. FIG. 18 is a sectional view of the portion illustrated in FIG. 17. FIGS. 19A through 19C are partial enlarged views of the portion illustrated in FIG. 18. FIG. 20 is an explanatory diagram illustrating the cleaning container 24 with the scooping sheet 15 heat-welded to the elastomer portion 10.

The present exemplary embodiment employs a scooping sheet 15 as follows: thickness: 38 μm; light transmission: 85% (in the case of a near-infrared radiation of 960 nm); material: polyester. First, as illustrated in FIG. 15A, the cleaning container 24 is prepared. In this process, undulation x as illustrated in FIG. 15B may be generated at the leading edge of the scooping sheet 15 (the portion to be brought into contact with the image bearing member 21) due to wrinkles of the scooping sheet itself, environmental fluctuations, or the like. Thus, when the scooping sheet 15 is mounted, a force receiving portion of the sheet mounting surface 24*d* of the cleaning container 24 (a force receiving portion receiving a force when curving the sheet mounting surface 24*d*) is pulled downwardly by the pulling jig 48 as illustrated in FIG. 16A. Due to the elastic deformation at this time, the sheet mounting surface 24*d* is curved, and this curving is released after the mounting of the scooping sheet 15 in this state. By thus curving the cleaning container 24, an initial tension amount n is applied to the leading edge of the scooping sheet 15 as illustrated in FIG. 16B, thereby preventing undulation. According to the present exemplary embodiment, the initial tension amount n is applied in a range from 0.5 mm to 0.8 mm.

As illustrated in FIGS. 17 through 19C, according to the present exemplary embodiment, the scooping sheet 15 is superimposed on the sheet mounting surface 24*d* so as to be in contact therewith, with the lower portion of the sheet mounting surface 24*d* of the elastomer portion 10 formed on the cleaning container 24 being curved using the pulling jig 48. Further, the scooping sheet 15 is pressed from above against a surface 49 regulating the sheet position so as to be in contact therewith by a pressing jig 45 having near-infrared transparency. With this operation, temporary positioning is effected so as to avoid deviation of relative position of the scooping sheet 15 with respect to the cleaning container 24 at the time of gluing of the scooping sheet 15.

Then, near-infrared radiation laser light e is applied by a laser irradiation head 60 in a direction from the scooping sheet 15 toward the sheet mounting surface 24*d* side of the elastomer portion 10 formed on the cleaning container 24. The elastomer portion 10 contains carbon black so that it will absorb near-infrared radiation. Thus, the applied laser light e is transmitted through the pressing jig 45 having near-infrared transparency and the scooping sheet 15 and absorbed by the sheet mounting surface 24*d* of the elastomer portion 10 formed on the cleaning container 24. The laser light absorbed by the sheet mounting surface 24*d* is converted to heat, and the sheet mounting surface 24*d* generates heat, with which the elastomer portion 10 is melted. Thus, the elastomer portion 10 can be welded (bonded) to the scooping sheet 15 held in contact with the sheet mounting surface 24*d*.

The laser light e irradiated from the irradiation head 60 is condensed to a circular shape of a diameter Ø1.5 mm when it reaches the sheet mounting surface 24*d*. That is, the laser spot diameter is Ø1.5 mm. Further, by making a formation width of the elastomer portion less than 1.5 mm, it is possible to uniformly melt the sheet mounting surface 24*d* of the elastomer portion 10. Thus, according to the present exemplary embodiment, a melting width e1 of the elastomer portion 10 is approximately 1.0 mm. The laser light is continuously irradiated in the longitudinal direction of the scooping sheet 15 from one end to the other end thereof. With this operation, it is possible to obtain a welding surface g1 continuous in the longitudinal direction as illustrated in FIG. 20.

As the pressing jig 45, it is desirable to employ a rigid member which has transparency with respect to the laser light e and can press the contact surface in whole between the scooping sheet 15 and the sheet mounting surface 24*d* of the elastomer portion 10 formed on the cleaning container 24. More specifically, it is desirable to employ acrylic resin, glass or the like.

When the elastomer portion 10 is formed as according to the present exemplary embodiment, the generation of a sink mark on the elastomer portion 10 at the injection port portion can be suppressed, so that a sink mark is not easily generated on the sheet mounting surface 24*d*. Thus, when pressing is performed by the pressing jig 45, it is possible to uniformly effect close contact between the sheet mounting surface 24*d* and the pressing jig 45 over the entire longitudinal area.

Accordingly, as illustrated in FIG. 19B, it is possible to obtain a uniform bonded surface g1 over the entire longitudinal area between the scooping sheet 15 and the elastomer portion 10 at the time of laser welding. On the other hand, FIG. 19C illustrates a comparative example. In this case, a sink mark exists on the sheet mounting surface 24*d* of the elastomer portion 10. Performing laser welding in this state results, for example, in a welded state in which a welding width is small in a part in the longitudinal direction as illustrated in FIG. 19C. Then, there is formed a portion 99 differing from the other portion, and the tensile force applied to the leading edge position 98 of this portion of the scooping sheet 15 is different from that at the other portion. Thus, the contact state with respect to the drum is adversely affected, and there is a possibility of a quality defect such as toner leakage.

The cleaning container 24 on which the elastomer portion 10 having the sheet mounting surface 24*d* is formed is formed of a resin material, and, when the scooping sheet 15 is mounted, the sheet mounting surface 24*d* is curved, and generates in some cases some asperity and deformation on the sheet mounting surface 24*d*. In addition, the relative position of the scooping sheet 15 with respect to the cleaning container 24 may be deviated. Therefore, according to the present exemplary embodiment, the pressing jig 45 is equipped with an elastic pressing member 47. Due to the pressing member 47, the scooping sheet 15 is temporarily set in a position with respect to the cleaning container 24 while elastically pressing the same, and it is possible to improve the hermetic contact between the scooping sheet 15 and the sheet mounting surface 24*d*. Further, positional deviation of the scooping sheet 15 can be prevented.

More specifically, as the pressing jig 45, there was used what is obtained by gluing an acrylic member 46 as a rigid member and a silicone rubber (pressure member) 47 of a thickness 5 mm as a elastic member together with a penetrable double-sided adhesive tape.

As the near-infrared irradiation device, there was used FD200 (wavelength: 960 nm) manufactured by Fine Device Co., Ltd, with the scanning speed in the longitudinal direction of the near-infrared irradiation device being 50 mm/sec, its output being 20 W, and the stop diameter on the elastomer portion surface being Ø1.5 mm. The energy density on the surface of the elastomer portion 10 was 0.22 J/mm$^2$. For the elastomer portion 10, there was used 100 parts by mass of styrene type elastomer resin containing 0.5 to 12.0 parts by mass of carbon black of a number average particle diameter of 16 nm.

The above-described method of bonding the scooping sheet 15 to the elastomer portion 10 formed on the cleaning container 24 is also applicable to welding of the blowout prevention sheet 16 to the elastomer portion 11 formed on the developing container 71. Similarly, it is also possible to apply the method to bonding of the charging roller cleaner 17 to the elastomer portion 13 formed on the cleaning container 24. Further, it is also applicable to welding of the scattering prevention sheet 18 to the elastomer portion 13 formed on the developing container 71. Furthermore, while the present exemplary embodiment uses the scooping sheet 15 of a light transparency of 85%, welding can be performed on a sheet member the light transparency of which 85% or less. Moreover, apart from the welding method according to the present exemplary embodiment, it is also possible to weld the elastomer portion 10 and the scooping sheet 15 to each other by a heat seal or the like. In the case of a heat seal or the like, it is impossible to exclusively apply heat to the contact interface between the scooping sheet 15 and the elastomer portion 10, and heat is conducted from the upper surface of the scooping sheet 15, so that it is necessary to take into consideration of the heat conduction time and melting of the scooping sheet 15.

As described above, according to the present exemplary embodiment, with respect to the elastomer portion and the injection port for forming the elastomer portion, the central axis in the direction in which at least a part of the resin flows to the downstream side of the injection path from the injection port until the formation of the molding formed in the frame member, is arranged at a position not within the injection port, so that it is possible to suppress the generation of a sink mark on the elastomer portion after the molding.

As described above, according to the present invention, a configuration for forming a seal member on a frame member through injection molding can suppress generation of a sink mark on a surface of the seal member near an injection port for a molten resin and reliably secure a sealing performance of the seal member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-237794 filed Oct. 29, 2012, which is hereby incorporated by reference herein in its entirety.

What is claimed is:

1. A unit to be used in an image forming apparatus, the unit comprising:

a developer storage portion configured to store a developer;

a frame member;

a seal forming portion provided on the frame member;

a seal member configured to prevent leakage of the developer to an exterior of the unit and to be formed on the seal forming portion through injection molding with a molten resin;

an injection path provided in the frame member and through which the molten resin flows when the seal member is formed through injection molding;

an injection port provided at one end side of the injection path in an injection direction in which the molten resin flows through the injection path, and through which the molten resin is injected into the frame member; and a discharge port which is provided at another end side of the injection path in the injection direction and is configured to discharge the molten resin having passed through the injection path to the seal forming portion, wherein the injection path penetrates linearly through the frame member and, in a direction perpendicular to the injection direction, the injection path includes a portion of which a sectional area is narrower than a sectional area of the injection port.

2. The unit according to claim 1, wherein a central axis of a cross section orthogonal to the injection direction of at least a part of the injection path passes a position deviated from the injection port.

3. The unit according to claim 2, wherein the part has the smallest cross section of the injection path.

4. The unit according to claim 1, wherein a central axis of a cross section orthogonal to the injection direction of at least a part of the injection path passes a position deviated from the discharge port.

5. The unit according to claim 1, wherein, in a direction perpendicular to the injection direction, the injection path includes a portion of which a sectional area is narrower than a sectional area of the discharge port.

6. The unit according to claim 1, wherein a central axis of a cross section orthogonal to the injection direction of the discharge port passes a position deviated from the injection port.

7. The unit according to claim 1, wherein a central axis of a cross section orthogonal to the injection direction of the injection port is deviated from a central axis of a cross section orthogonal to the injection direction of the discharge port.

8. The unit according to claim 1 further comprising a cleaning member configured to remove a developer from a surface of an image bearing member, and wherein the seal member is used to seal between the cleaning member and the frame member.

9. The unit according to claim 1, wherein the seal member is formed of an elastomer resin having elasticity.

10. The unit according to claim 1 further comprising a sheet member configured to prevent a developer from leaking to the exterior of the unit by being in contact with a surface of an image bearing member, and wherein the seal member is used to seal between the sheet member and the frame member.

11. The unit according to claim 1 further comprising a developer regulating member configured to regulate an amount of a developer carried by a developer carrying member, and wherein the seal member is used to seal between the developer regulating member and the frame member.

12. The unit according to claim 1, further comprising a sheet member configured to prevent a developer from leaking to the exterior of the unit by being in contact with a surface of a developer carrying member, and wherein the seal member is used to seal between the sheet member and the frame member.

13. The unit according to claim 1, wherein the unit is detachably attachable with respect to an apparatus main body of the image forming apparatus.

* * * * *